United States Patent [19]

Winter et al.

[11] Patent Number: 4,561,526

[45] Date of Patent: Dec. 31, 1985

[54] STEERING AND SUPPORT HANDLE FOR WHEELED LUGGAGE

[75] Inventors: Roger D. Winter; James K. Jennings, Jr., both of Lakewood, Colo.

[73] Assignee: Samsonite Corporation, Denver, Colo.

[21] Appl. No.: 453,813

[22] Filed: Jan. 3, 1983

[51] Int. Cl.[4] ..... A45C 5/14; A45C 13/26

[52] U.S. Cl. ..... 190/115; 190/18 A; 190/39; 16/112; 16/115; 16/DIG. 12

[58] Field of Search ..... 190/18 A, 39, 115; 16/126, 115, 116 R, 112, DIG. 12; 280/37

[56] References Cited

U.S. PATENT DOCUMENTS

| | | | |
|---|---|---|---|
| 959,235 | 5/1910 | Lemieux | 190/39 X |
| 1,421,098 | 6/1922 | Phillips | 16/DIG. 12 X |
| 1,616,632 | 2/1927 | Mastrontonio . | |
| 1,908,834 | 5/1933 | Engberg et al. | 16/116 R X |
| 2,002,836 | 5/1935 | Rossi | 190/18 A X |
| 3,257,120 | 6/1966 | Browning . | |
| 3,805,929 | 4/1974 | Kuwayama | 190/18 A |
| 3,948,365 | 4/1976 | Gregg et al. | 190/18 A |
| 4,023,702 | 5/1977 | McKnight | 16/126 X |
| 4,115,669 | 9/1978 | Cali | 16/115 X |
| 4,118,048 | 10/1978 | Spranger et al. | 190/18 A X |
| 4,299,313 | 11/1981 | Null | 190/18 A |

FOREIGN PATENT DOCUMENTS

| | | | |
|---|---|---|---|
| 487220 | 11/1953 | Italy | 190/18 A |
| 2030966 | 4/1980 | United Kingdom | 190/18 A |
| 1600156 | 10/1981 | United Kingdom | 190/115 |
| 2111465 | 7/1983 | United Kingdom | 190/115 |

*Primary Examiner*—William Price
*Assistant Examiner*—Sue A. Weaver
*Attorney, Agent, or Firm*—John R. Ley

[57] ABSTRACT

A steering and support handle for a wheeled luggage case is operatively pivotably connected to the wheeled luggage case to pivot to an operative or extended position in front of the case or to an inoperative or closed position adjoining the case. Means operative on the pivoted end of the handle biases the handle to maintain the operative position upon movement of the handle into the operative position and biases the handle to maintain the inoperative position upon movement of the handle into the inoperative position. The pivoted end of the handle is connected to the case by connecting means which provides a shoulder which is contacted by a surface on the pivoted end of the handle when the handle is moved to the operative position. The handle is T-shaped and its crossed end piece can be conveniently gripped in the hand of the user. The handle is preferably located in an indented marginal area at the closure location of the two opposed case halves or shells.

23 Claims, 8 Drawing Figures

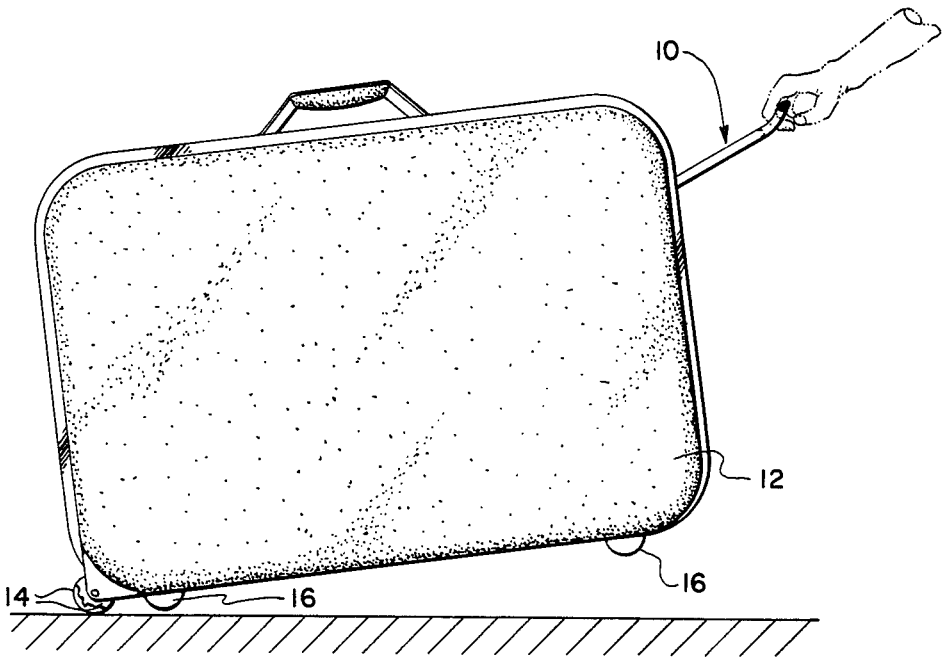
Fig. 1
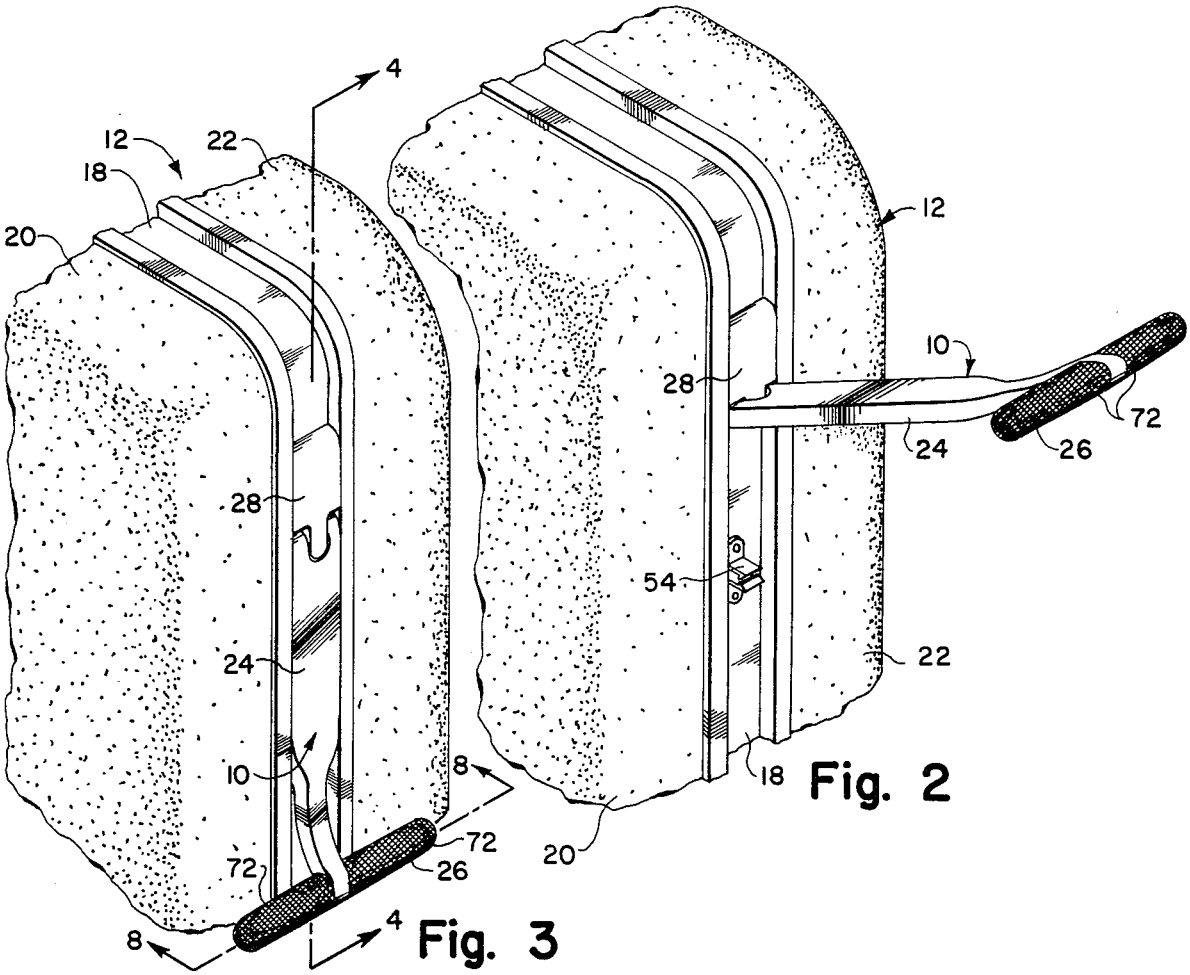
Fig. 2
Fig. 3

STEERING AND SUPPORT HANDLE FOR WHEELED LUGGAGE

This invention pertains to luggage cases using wheels upon which the case can be rolled, without lifting and carrying the case. More specifically, the invention pertains to a handle which can be selectively moved to an operative position for positioning the luggage case on its wheels and for steering the luggage case as it rolls on its wheels.

Attaching wheels to a luggage case to allow the case to be rolled rather than carried to its destination is an old and well known concept. Steering devices have also been attached to wheeled luggage cases for manipulating the movement of the case as it is rolled. One type of steering device is a flexible tether-type strap. A tether strap is normally employed on a luggage case that has wheels which fully support the case from the floor or other support surface. The function of the flexible tether strap is simply a lead for guiding the luggage case on its wheels. The disadvantage of the flexible tether strap is that it is somewhat difficult to guide or control the case because the flexibility of the strap and the mobility of the wheels. Another type of steering device, which is normally regarded as more desirable, is a selectively extendable rigid support and steering handle. The rigid handle is employed to lever the weight of the case and its contents onto a single pair of rear wheels. With the weight supported only by the single pair of rear wheels, the case can be more precisely steered because of the rigid operative connection of the handle to the case and the high degree of maneuverability provided by the single pair of rear wheels. Although the user must support a part of the weight of the case and its contents from the handle, the mechanical advantage achieved from a lever effect substantially reduces the force required, as compared to the force required for fully lifting the case. Because the single pair of support wheels only contacts the floor when the case is levered into the operative position, the case can be stationarily positioned on bottom foot supports when it is not rolled.

INVENTION SUMMAARY

The present invention is for a new and improved steering and support handle for a wheeled luggage case. The steering and support handle is operatively pivotably connected to the wheeled luggage case to pivot to an operative or extended position in front of the case or to an inoperative or closed position adjoining the case. Means operative on the pivoted end of the handle biases the handle to maintain the operative position upon movement of the handle into the operative position and biases the handle to maintain the inoperative position upon movement of the handle into the inoperative position. The position of the handle is thereby maintained. The pivoted end of the handle is connected to the case by connecting means which provides a shoulder which is contacted by a surface on the pivoted end of the handle when the handle is moved to the operative position. The weight of the case and its contents maintains the contact when the handle is grasped and lifted and thereby provides a direct operative connection of the handle to the case for steering the case. The shoulder and surface contact arrangement avoids the necessity for further additional bracing members and the like to maintain the handle in the operative position. The handle is T-shaped and its crossed end piece can be conveniently gripped in the hand of the user and greater torsional force can be applied to resist sideways tipping of the case as it is rolled. The handle is preferably located in an indented marginal area at the closure location of the two opposed case halves or shells.

The nature and details of the present invention are more completely understood by reference to the following description of the preferred embodiment taken in conjunction with the drawings, and from the appended claims.

DRAWINGS

FIG. 1 is a side elevation view of a wheeled luggage case and the steering and support handle of the present invention shown in an extended or operative position.

FIG. 2 is a perspective view of the steering and support handle shown in FIG. 1 and a portion of the luggage case adjacent the handle.

FIG. 3 is a perspective view of the steering and support handle and a portion of the luggage case adjacent the handle, with the handle shown in a down or inoperative position, as compared to FIGS. 1 and 2.

PREFERRED EMBODIMENT

Figure 4:
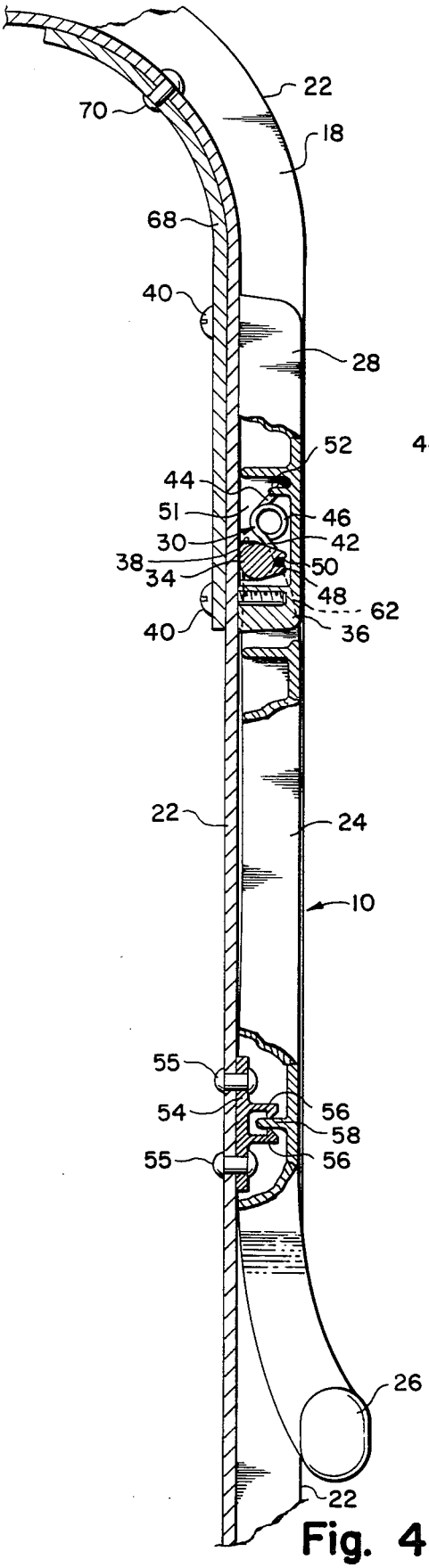
FIG. 4 is a section view taken through the handle taken substantially in the plane of line 4—4 of FIG. 3.

The steering and support handle of the present invention is referenced 10 in the Drawings and is introduced by reference to FIGS. 1, 2 and 3. The handle 10 is preferably intended for use with a luggage case 12 having a pair of wheels 14 attached thereto at a lower bottom corner adjacent a rear side of the case 12. In the operative position, the handle 10 extends forward and slightly upward from a front side of the case 12 at a location near an upper front corner which is essentially diagonally spaced across the case from the rear wheels 14. When the case 12 rests on a floor or other support surface, bottom support feet 16 extending downward from the bottom of the case contact the floor. To roll the case 12 on its rear wheels, a user grips the handle 10 and lifts the handle upward, thereby levering the weight of the case 12 and its contents from the feet 16 onto the rear wheels 14. A lever effect created between the gripped handle 10 and the fulcrum point at the wheels 14 reduces the amount of physical force necessary to hold the case 12 in the rolling position shown in FIG. 1. Force applied by the user's hand to the handle 10 is directly and firmly transmitted to the case 12 and to the wheels 14. The rolling point at the wheels 14 and the rigid operative connection of the handle 10 to the case 12 allow the user to directly and effectively control and maneuver the rolled case.

The handle 10 is pivotably connected to the front side of the case 12 to move between the extended operative position shown in FIGS. 1 and 2, and an inoperative position shown in FIG. 3. The handle 10 is moved in the inoperative position when not in use. Preferably, the case 12 is of the type having a recessed marginal area 18 adjoining the location where the two halves 20 and 22 of the case 12 join together when the case is closed. A majority of the handle 10 is retained in the recessed marginal area 18 when the handle occupies the inoperative position, as shown in FIG. 3.

The handle 10 is preferably T-shaped, thereby having a longitudinal piece 24 and a cross piece 26 extending transversely from the outer end of the longitudinal piece 24. The outer end of the longitudinal piece 24 adjacent the cross piece 26 is slightly angled to position the cross piece 26 adjoining the case halves 20 and 22 and outside of the indented marginal area 18 when the case is closed and the handle is in the inoperative position, as shown in FIGS. 3 and 4. A hinge block 28 pivotably connects and retains the pivoted end of the handle 10 to the case 12 at the case half 22. Force from the user on the cross portion 26 of the T-shaped handle 10 is rigidly transmitted to the case for steering and supporting the case. A spring 30 operatively biases or holds the handle 10 in either its extended operative position or its inoperative position, once the handle is moved to either position. Except as otherwise noted, the handle and hinge block are constructed from strong rigid material such as metal.

Details of the nature and operation of the handle 10, the hinge block 28 and the spring 30 are illustrated in FIGS. 4, 5, 6 and 7. The pivoted end of the longitudinal piece 24 of the handle 10 essentially comprises a pair of transversely spaced marginal side extensions 32 and a pivot shaft 34 extending transversely between the extensions 32 at the extreme end thereof. The shaft 34 defines the axis about which the handle 10 pivots. The hinge block 28 includes a neck portion 36 which extends into the space between the transversely separated extensions 32. A U-shaped opening 38 extends transversely across the neck portion 36 and receives therein the pivot shaft 34 of the longitudinal piece 24 of the handle 10. Fastening means such as bolts 40 extend from the interior of the case half 22 into receptacles in the hinge block 28 and thereby firmly attach the hinge block 28 to the case half 22. With the hinge block 28 rigidly attached to the case half 22, the pivot shaft 34 is confined within the U-shaped opening 38 and against the case half 22, but the handle 10 is free to pivot at the pivot shaft 32. The connection arrangement prevents the handle 10 from pivoting about the other two mutually perpendicular axes with reference to the axis parallel to the pivot shaft 32.

Figure 5:
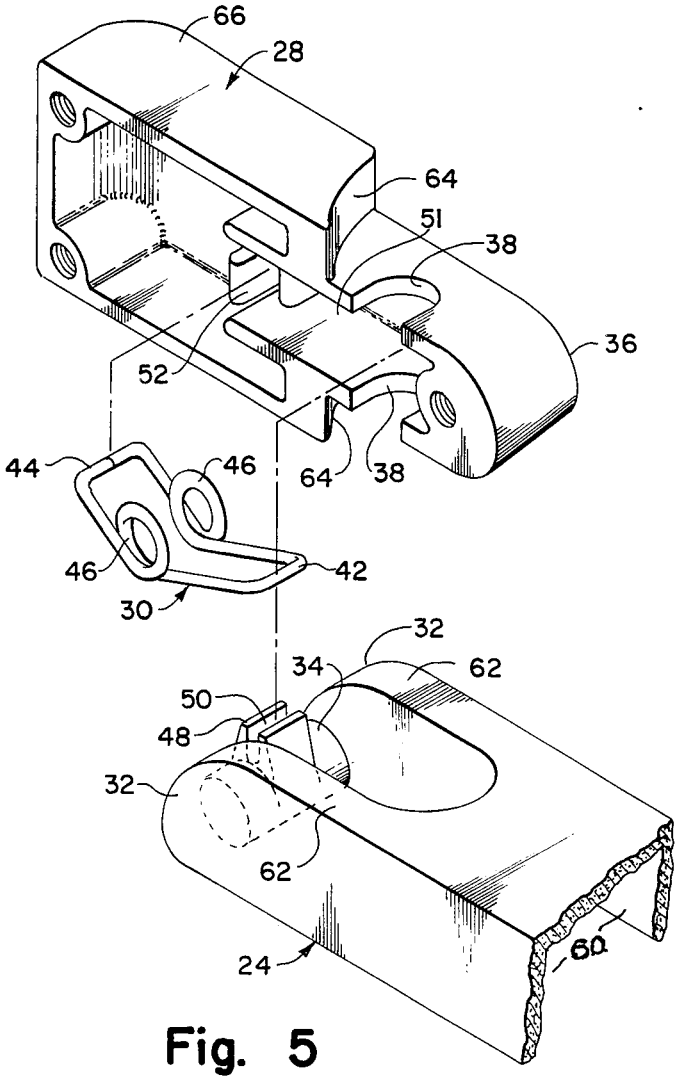
FIG. 5 is an exploded view of the pivoted end of the handle shown in the foregoing FIGURES, a hinge block which operatively connects the pivoted end of the handle to the case, and a spring operative between the hinge block and the pivoted end of the handle for holding the handle in either the operative or inoperative position.

The spring 30 is shown in FIG. 5 as comprising a pair of obliquely angularly oriented lever arms 42 and 44 joined together by a pair of coils 46. The lever arms 42 and 44 and the coils 46 of the spring 30 are integrally formed from a single piece of spring wire which has been bent into the described orientation. The outer end of one lever arm, e.g. 42, is retained within a slot 50 of a shaft which extends from a center location of the pivot shaft 34. The shaft lever 48 essentially extends perpendicularly with respect to the longitudinal dimension of the longitudinal piece 24 of the handle 10 (FIG. 4). The slot 50 positions the end of the spring arm 42 at a location radially or eccentrically displaced from the center axis pivot point of the pivot shaft 34. The outer end of the other spring arm, e.g. 44, fits within and is stationarily positioned within retention slot 52 in the hinge block 28.

Figure 6:
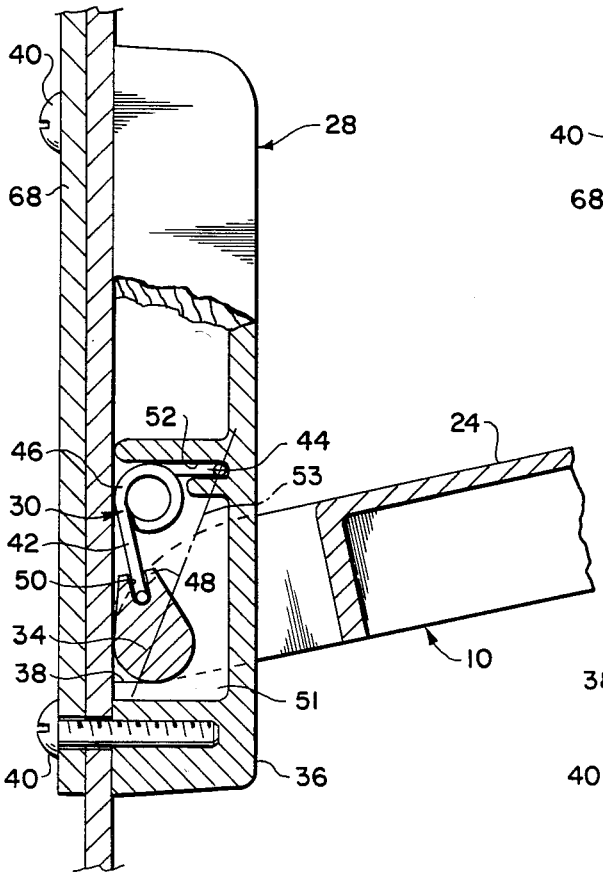
FIG. 6 is an enlarged section view taken in the same plane as FIG. 4 illustrating the pivoted end of the handle, the hinge block, and the spring in assembled relationship, with the handle in the operative position.

The spring arms 42 and 44 normally extend at an oblique angle with respect to one another when the spring 30 is not deflected. When the spring 30 is assembled into an interior opening 51 of the hinge block 28 with the ends of the arms 42 and 44 in the slots 50 and 52, respectively, as shown in FIGS. 4 and 6, the arms 42 and 44 extend at a lesser oblique angle with respect to one another. Accordingly, when the spring arms are moved to a lesser oblique angle with respect to one another, a torsion force is developed by the spring 30 which tends to force the arms 42 and 44 toward a greater oblique angle with respect to one another. The torsion force derived from deflection of the spring 30 attempts to force the ends of the arms 42 and 44 away from one another. This force is applied continually between the slots 50 and 52 regardless of the position of the handle 10 due to the deflection of spring arms 42 and 44 when the spring 30 is assembled into operative relationship between the hinge block 28 and the pivoted end of the handle 10. In the inoperative position shown in FIG. 4, the slot 50 is to the right of an imaginary center line (53 shown in FIG. 6) between the end of spring arm 44 in the slot 52 and the center axis pivot point of the pivot shaft 34. Therefore, a clockwise rotational torque is developed on the handle because of the the orientation of the shaft lever 48 and position of the slot 50 with respect to the axis of the pivot shaft 34. In the extended or operative position shown in FIG. 6, counterclockwise rotational torque is developed to hold the handle in this position because the shaft lever 48 and the slot 50 are located to the left of the imaginary center line 53 between the end if spring arm 44 in the slot 52 and the axis of pivot shaft 34.

The distance between the slots 50 and 52 is less when the handle 10 is in its extended operative position than when the handle is in the inoperative position. Accordingly, more torsional force is developed by the spring 30 when the distance between the ends of the arms 42 and 44 is reduced. To aid in maintaining the handle in the inoperative position and to resist dislodgment from within the recessed marginal area 18 during luggage movement and handling, etc., a retention clip 54 is provided as shown in FIG. 4. The retention clip 54 is attached by fasteners such as rivets 55 to the case half 22. The retention clip 54 comprises a pair of oppositely and inwardly spaced resilient point members 56. The point members contact and frictionally engage a rib 58 extending transversely across longitudinally extending sides of the longitudinal piece 24. The longitudinal piece 24 has a downward or bottom facing U-shaped interior 60 which is essentially open (FIG. 5) except for the rib 58.

Figure 7:
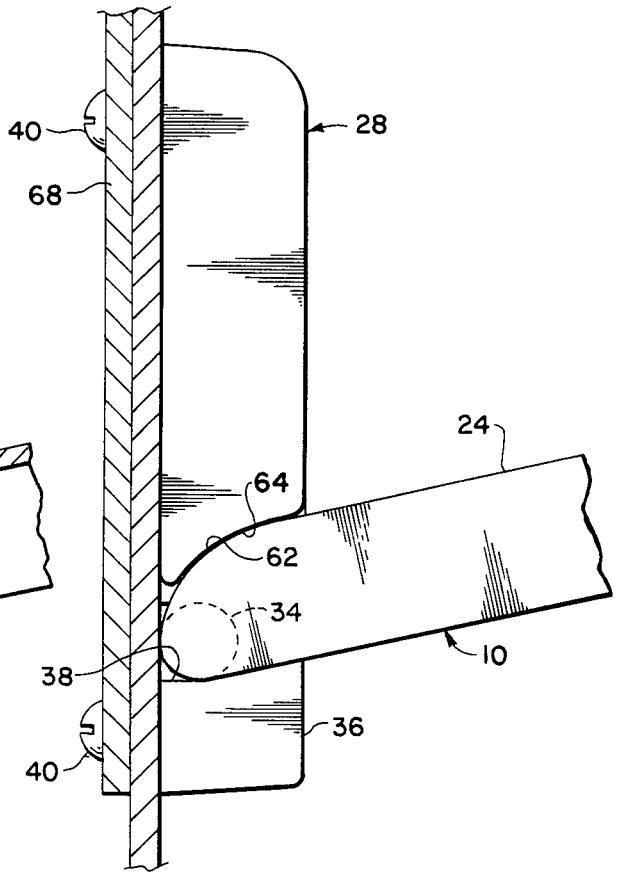
FIG. 7 is an enlarged view taken in a plane in front of the handle and hinge block as shown in FIG. 6.

When the handle 10 is moved to the operative extended position, outer surfaces 62 of the extensions 32 rest against shoulders 64 of the hinge block 28, as shown in FIG. 7. In this position, the handle 10 extends at a slight oblique angle with respect to its inoperative position and the vertical side of the case. The shoulders 64 extend transversely outward from each side of the neck portion 36 and are defined by a larger base portion 66 of the hinge block 28. The base portion 66 of the hinge block is essentially the same width as the transverse width of the longitudinal portion 24 of the handle 10, thereby achieving an aesthetically pleasing appearance of continuing the longitudinal piece 24 of the handle 10, as shown in FIG. 3. The shoulders 64 define stop members which limit the amount of pivoting movement of the handle. Once the shoulders 64 are contacted by the surfaces 62, the weight of the case and its contents are resisted by the hinge block 28. In order to distribute this weight and force throughout a larger portion of the case half 22, a backing plate 68 is employed. Accordingly, a portion of the case half 22 is sandwiched between the hinge block 28 and the backing plate 68. The backing plate 68 is held in position by the fasteners 40 and additional fasteners, for example rivets 70. By contacting the surfaces 62 of the handle 10 against the shoulders 64 of the hinge block 28 and employing the backing plate 68, the necessity for additional sliding triangular braces and the like is avoided. The weight of the case and the slightly obliquely angled handle in the extended operative position maintain the handle in the extended position and provide a rigid operative connection of the handle 10 to the case 12 for steering and supporting the case.

Figure 8:
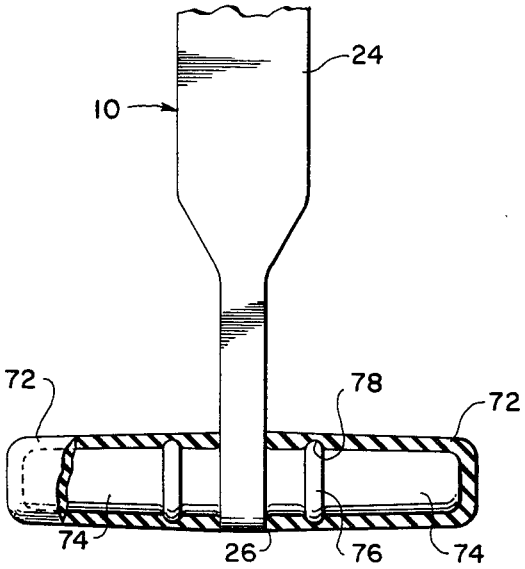
FIG. 8 is a section view illustrating the attachment of grip members or bumpers to the handle.

The cross piece 26 of the handle 10 includes a pair of bumper or grip members 72 extending transversely outward from the outer end of the longitudinal piece 24. The grip members 72 are retained on cross piece extensions 74 which extend transversely outward from and are integral with the longitudinal piece 24, as shown in FIG. 8. Each grip member 72 is formed preferably of resilient material such as rubber and in the form of an elongated cup. The open end of the grip member is slipped over an extension 74. Each extension 74 includes a rib 76 which extends transversely around the periphery of the extension. Each grip member 72 includes a groove 78 formed therein at a location to mate with the rib 76. The resilient material of the grip member 72 is expanded slightly when the grip member is placed over the extension 74 and the resulting force aids in maintaining the grip members 72 on the extensions 74. The mating relationship of the rib 76 and groove 78 also assist in retaining the grip members 2 on the extensions 74.

The material of the grip members 72 is sufficiently soft to be comfortable to grasp when supporting the luggage case from its wheels and steering the luggage case. The resilient material of the grip members acts as a bumper against the case halves to absorb energy if the handle is flipped downward with force to the inoperative position. The T-shaped handle further allows the user to apply torsional wrist action to the handle 10 to resist tipping of the case, if the case is rolled over uneven surfaces.

The nature and operation of the present invention has been shown and described with a degree of specificity. It should be understood, however, that the specificity of the description has been made by way of preferred example and that the invention itself is defined by the scope of the appended claims.

What is claimed is:

1. An improved steering device for a luggage case having wheels upon which the case can be rolled, comprising in combination therewith:

a handle having a pivoted end and an end adapted to be grasped for steering the case on its wheels;

means connecting the pivoted end of the handle to the case and retaining the handle for pivotiing movement between an inoperative position wherein the handle extends generally adjacent a side of the case and an operative position wherein the handle extends outward from the side of the case to be gripped for steering the case on its wheels; and means operative on the pivoted end of the handle for biasing the handle to maintain the operative position upon movement of the handle into the operative position and for biasing the handle to maintain the inoperative position upon movement of the handle to the inoperative position, said biasing means comprising a spring having opposite ends and operatively developing an operative force effective between its ends; and wherein the pivoted end of the handle includes a lever extending radially outward therefrom with respect to a pivot axis of the handle, one end of the spring is mechanically connected to the lever at a fixed position eccentrically located with respect to the pivot axis of the handle, the lever extends from the handle at a predetermined angle by which the spring is operative on the lever when the handle is in the operative position to develop a rotational torque in one rotational direction and by which the spring is operative on the lever when the handle is in the inoperative position to develop a rotational torque in the opposite rotational direction.

2. An improved steering device for a luggage case having wheels upon which the case can be rolled, comprising in combination therewith:

a handle having a pivoted end and an end adapted to be grasped for steering the case on its wheels;

means connecting the pivoted end of the handle to the case and retaining the handle for pivoting movement between an inoperative position wherein the handle extends generally adjacent a side of the case and an operative position wherein the handle extends outward from the side of the case to be gripped for steering the case on its wheels; and means operative on the pivoted end of the handle for biasing the handle to maintain the operative position upon movement of the handle into the operative position and for biasing the handle to maintain the inoperative position upon movement of the handle to the inoperative position, said biasing means comprising a spring having opposite ends and operatively developing an operative force effective along a line between its ends; and wherein the pivoted end of the handle includes a lever extending at a predetermined angle radially outward with respect to a pivot axis of the handle, one end of the spring pivotably connected to the lever at a position eccentrically spaced with respect to the pivot axis of the handle, the other end of the spring mechanically connected in a stationary location spaced from the pivot axis of the handle, the predetermined angle operatively locating the position at which the one end of the spring is connected to the lever on one transverse side of a reference line extending between the other end of the spring and the pivot axis of said handle when the handle is in one position to develop a rotational torque in one direction and operatively locating the position at which the one end of the spring is connected to the lever on the other opposite side of the reference line when the handle is in the inoperative position to develop a rotational torque in the opposite rotational direction about the pivot axis.

3. An improved steering device for a luggage case having wheels upon which the case can be rolled, comprising in combination therewith:

a handle having a pivoted end and an end adapted to be grasped for steering the case on its wheels;

means connecting the pivoted end of the handle to the case and retaining the handle for pivoting movement between an inoperative position wherein the handle extends generally adjacent a side of the case and an operative position wherein the handle extends outward from the side of the case to be gripped for steering the case on its wheels, the pivoted end of the handle including a lever extending at a predetermined angle outward with respect to a pivot axis of the handle; and means operative on the pivoted end of the handle for biasing the handle to maintain the operative position upon movement of the handle into the operative position and for biasing the handle to maintain the inoperative position upon movement of the handle to the inoperative position, said biasing means comprising a spring having a pair of lever arms joined together by a coil, the end of one lever arm being operatively connected to the lever at the pivoted end of the handle, the end of the other lever arm being operatively connected to said connecting means, the lever arms normally extending at an oblique angle with respect to one another, the coil developing force when the lever arms extend at a lesser oblique angle than the normal oblique angle and the lever arms extending at a lesser oblique angle when the handle is in the operative and inoperative positions.

4. An improved steering and support device for a luggage case having wheels at a lower bottom corner adjacent a rear side thereof upon which to roll the case and its contents when the case is supported from the wheels, comprising in combination:

a handle having a pivoted end and a gripping end adapted to be grasped for levering and supporting the weight of the case and its contents on the rear wheels and for steering the case as it is rolled on its rear wheels, said handle being generally T-shaped having a longitudinal portion extending from the pivoted end to the gripping end, and the gripping end being defined substantially by a cross piece extending transversely from the end of the longitudinal piece opposite the pivoted end;

a hinge block connected to the case on a front side near an upper corner, the hinge block operatively connecting the handle to the case substantially only at the pivoted end, said hinge block operatively retaining the handle for pivoting movement between an inoperative position wherein the handle extends generally downward toward the bottom of the case adjacent a front side of the case and an operative position wherein the handle extends forward and slightly upward from the hinge block;

the pivoted end of the handle comprising a pair of transversely spaced apart extensions extending longitudinally forward on opposite transverse sides of the pivoted end of the longitudinal piece of the handle, a pivot shaft extending transversely across the space between the extensions, and a shaft lever extending from the pivot shaft;

the hinge block comprising a base portion and a neck portion of reduced transverse width extending from the base portion, the base and neck portions defining an interior opening within the hinge block, the neck portion having a pivot opening extending transversely therethrough to receive the pivot shaft of the handle, the shaft lever fitting within the interior of the opening in the hinge block when the pivot shaft is received in the pivot opening;

a spring retained within the interior opening of the hinge block and operative between the shaft lever and the hinge block to develop a torsional force on the handle in a rotational direction for maintaining the handle in the inoperative position when the handle is manually moved to the inoperative position and operative to develop a torsional force in the opposite rotational direction for maintaining the handle in the operative position when the handle is manually moved to the operative position.

5. A steering and support device as defined in claim 4 wherein the spring comprises a pair of lever arms joined together by a coil, the end of one lever arm operatively connecting to the shaft lever, the end of the other lever arm operatively connecting to the hinge block, the lever arms normally extending at an oblique angle with respect to one another, the coil developing force when the lever arms are bent at a lesser oblique angle than the normal oblique angle, and the lever arms extending at a lesser oblique angle when the handle is in either the operative or inoperative position; and the shaft lever extends from the pivot shaft at a predetermined angle to extend on opposite transverse sides of an imaginary reference line between the pivot shaft axis and the end of the lever arm connected to the hinge block to develop the torsional forces in opposite rotational directions when the handle is in the inoperative and operative positions.

6. A steering and support device as defined in claim 4 wherein:

the hinge block includes a shoulder extending transversely out from the neck portion at the base portion, the extensions of the pivoted end of the longitudinal piece of the handle defines surfaces adapted to contact the shoulder to limit the amount of pivoting movement of the handle to the operative position, and the weight of the case and its contents when the case is supported by the rear wheels and the gripped handle maintains the surface of the extensions in contact with the shoulder of the hinge block and force is transmitted between the handle and the hinge block for supporting the case from its wheels through the contact of the handle and the hinge block at the shoulder and extension surface.

7. A steering and support handle as defined in claim 4 wherein the hinge block is attached to an indented marginal area of the case at a location where halves of the case separate from one another, and the majority of the longitudinal portion of the handle also extends within the indented marginal area when the handle is in the inoperative position, and further comprising retention clip means connected to the case in the indented marginal area for contacting the handle adjacent its gripping end when the handle is in the inoperative position and developing retaining force on the handle in the inoperative position.

8. An improved steering device for a luggage case having wheels upon which the case can be rolled, comprising a combination therewith:

a handle having a pivoted end and an end adapted to be grasped for steering the case on its wheels;

means connecting the pivoted end of the handle to the case and retaining the handle for pivoting movement between an inoperative position wherein the handle extends generally adjacent a side of the case and an operative position wherein the handle extends outward from the side of the case to be gripped for steering the case on its wheels; and means operative on the pivoted end of the handle for biasing the handle to maintain the operative position upon movement of the handle into the operative position and for biasing the handle to maintain the inoperative position upon movement of the handle to the inoperative position, said biasing means comprising a torsion spring having opposite ends and operatively developing an operative force effective between its ends; and wherein one end of the spring is connected to the pivoted end of the handle at a location eccentrically spaced with respect to an axis about which the handle pivots.

9. An improved steering device for a luggage case having wheels upon which the case can be rolled, comprising in combination therewith:

a handle having a pivoted end and an end adapted to be grasped for steering the case on its wheels;

means connecting the pivoted end of the handle to the case and retaining the handle for pivoting movement between an inoperative position wherein the handle extends generally adjacent a side of the case and an operative position wherein the handle extends outward from the side of the case to be gripped for steering the case on its wheels; and means operative on the pivoted end of the handle for biasing the handle to maintain the operative position upon movement of the handle into the operative position and for biasing the handle to maintain the inoperative position upon movement of the handle to the inoperative position, said biasing means comprising a spring having opposite ends and operatively developing an operative force effective between its ends; and wherein one end of the spring is connected to the pivoted end of the handle at a location eccentrically spaced with respect to an axis about which the handle pivots;

the other end of the spring is mechanically connected in a stationary location spaced from the pivot axis of the handle, and the one end of the spring is located on one transverse side of a reference line between the pivot axis of the handle and the other end of the spring when the handle is in the operative position and is located on the opposite transverse side of the reference line when the handle is in the inoperative position.

10. A steering device as defined in claims 1, 8 or 9 wherein the one end of the spring is pivotably connected to the handle at the pivoted end.

11. A steering device as defined in claims 1, 2 or 3 wherein said connecting means comprises a hinge block having an interior opening within which the spring is operatively retained, and the lever of the pivoted end of the handle extends into the interior opening.

12. A steering device as defined in claim 11 wherein said handle and said hinge block further cooperatively comprise means for limiting the amount of pivoting movement of the handle only to the operative position from the inoperative position, and said limiting means further comprises a shoulder on the hinge block and a surface on the handle adapted to contact and rest against the shoulder when the handle occupies the operative position.

13. A steering device as defined in claims 8 or 9 wherein:

said connecting means comprises a hinge block pivotably connecting the pivoted end of the handle to the case; and said handle and said hinge block further cooperatively comprise means for limiting the amount of pivoting movement of the handle only to the operative position from the inoperative position, and said limiting means further comprises a shoulder on the hinge block and a surface on the handle adapted to contact and rest against the shoulder when the handle occupies the operative position.

14. A steering device as defined in claim 13 wherein the handle is T-shaped and is defined by a longitudinal piece extending from the pivoted end and by a cross piece extending transversely from the longitudinal piece at an end opposite the pivoted end.

15. A steering device as defined in claim 14 further comprising resilient grip members attached on the cross piece.

16. A steering device as defined in claim 12 wherein the handle is T-shaped and is defined by a longitudinal piece extending from the pivoted end and by a cross piece extending transversely from the longitudinal piece at an end opposite the pivoted end.

17. A steering device as defined in claim 16 further comprising resilient grip members attached on the cross piece.

18. An steering device as defined in claims 1, 2, 8 or 9 wherein said spring operatively develops a force between its ends tending to force the ends of the spring further apart.

19. A steering device as defined in claim 3 wherein the spring is a torsion spring having one end which is the end of the one lever arm operatively connected to the lever and also having an other end which is the end of the other lever arm operatively connected to said connecting means, and the torsion spring develops a force tending to force the ends of the spring further apart.

20. An improved steering device as defined in claims 1, 8 or 19 wherein the one end of the spring is located on one transverse side of a reference line extending between the pivot axis at the pivoted end of the handle and the other end of the spring when the handle is in the operative position and is located on the other opposite transverse side of the reference line when the handle is in the inoperative position.

21. A steering device as defined in claims 1, 2, 3, 8 or 9 the handle is T-shaped and is defined by a longitudinal portion extending from the pivoted end and by a cross piece portion extending transversely from the longitudinal portion at an end opposite the pivoted end.

22. An improved steering device as defined in claim 21 further comprising resilient grip members attached on the cross piece.

23. A steering device as defined in claims 1, 2 or 9 herein said spring is a torsion spring.

* * * * *